United States Patent [19]

Edwards

[11] 3,964,658

[45] June 22, 1976

[54] ROLLER REPLACING

[76] Inventor: Edwin L. Edwards, 24 York Terrace, Brookline, Mass. 02146

[22] Filed: Sept. 4, 1974

[21] Appl. No.: 503,115

[52] U.S. Cl. ..... 226/190; 29/125

[51] Int. Cl.[2] ..... B65H 17/20

[58] Field of Search ..... 226/185, 190, 191, 194; 29/124, 125

[56] References Cited

UNITED STATES PATENTS

| | | | |
|---|---|---|---|
| 1,292,244 | 1/1919 | Brown | 29/125 UX |
| 2,324,050 | 7/1943 | Shelley | 29/125 |
| 3,054,163 | 9/1962 | Lakin | 29/125 |
| 3,351,001 | 11/1967 | Achkio | 29/125 X |
| 3,478,555 | 11/1969 | Achler | 29/125 X |

*Primary Examiner*—Richard A. Schacher
*Attorney, Agent, or Firm*—Charles Hieken; Jerry Cohen

[57] ABSTRACT

A roller assembly for drawing webs of plastic film or the like comprises an elongated shaft disposed laterally to the direction of web movement with multiple resilient roll portions along its length. Each of the roll portions has multiple roll segments each separately replaceable to allow compensation for uneven wear along the length of the shaft.

6 Claims, 2 Drawing Figures

ROLLER REPLACING

BACKGROUND OF THE INVENTION

The present invention relates in general roller replacing in assemblies for drawing and material such as plastic film, textiles and the like, and more particularly concerns a novel assembly with individually replaceable rollers segments that facilitates maintaining uniform web guiding characteristics with ease and alternatively little cost.

Plastic film webs are drawn and guided through various forms of equipment including film treating machinery and rolling/unrolling apparatus, which employ flexible surfaced rollers such as the so-called "squeegee" or draw rollers. Center portions of the rollers receive more wear than edge portions. Although edge portions may be usable, prior art complete rollers are replaced when the center portion wears out or is damaged, at great expense in transportation and inconvenience including downtime of production.

It is an important object of the invention to overcome the disadvantages just described.

It is a further object of the invention to provide economical and easily effected selective replacement of only worn portions of a flexible surfaced roller consistent with the preceding object.

It is a further object of the invention to provide modular subassemblies which are interchangeable consistent with one or more of the preceding objects.

It is a further object of the invention to achieve one or more of the preceding objects through worn element replacement easily and rapidly by relatively unskilled personnel.

SUMMARY OF THE INVENTION

According to the invention, a flexable surfaced roller assembly comprises a central shaft carrying an array of flexible surfaced roll segments along its length. Each roll segment comprises roller portions separated by annular notches or spacers. The segments are separated by a similarly dimensioned notch defined by a spacer ring between segments. Each roll segment has a central annular core with one or more keyways therein alignable with corresponding keyways on the shaft, and a keyway stabling insert bar may be inserted into each pair of aligned keyways of the shaft and segment core. The cores end flush with the end faces of the segments which are in place with spring clamps and are held interchangeable at any given location along the shaft or between different longitudinal locations along the shaft.

Preferably, the central shaft carries three or more roll segments. Surface wear is usually greater in the intermediate or center roll segment(s) than in the end roll segments. Center roll segments may then be replaced more frequently than end segments. Replacement is easily effected by removing the insert bars, sliding the segments to be removed off the shaft, sliding on the replacement segments, and aligning the keyways of all the segments with the shaft keyways and reinserting the keyway stabling insert bars.

These and other objects, features and advantages of the invention will be apparent from the following detailed description of preferred embodiments taken in connection with the accompanying drawing in which:

DETAILED DESCRIPTION OF PREFERRED EMBODIMENTS

Figure 1:
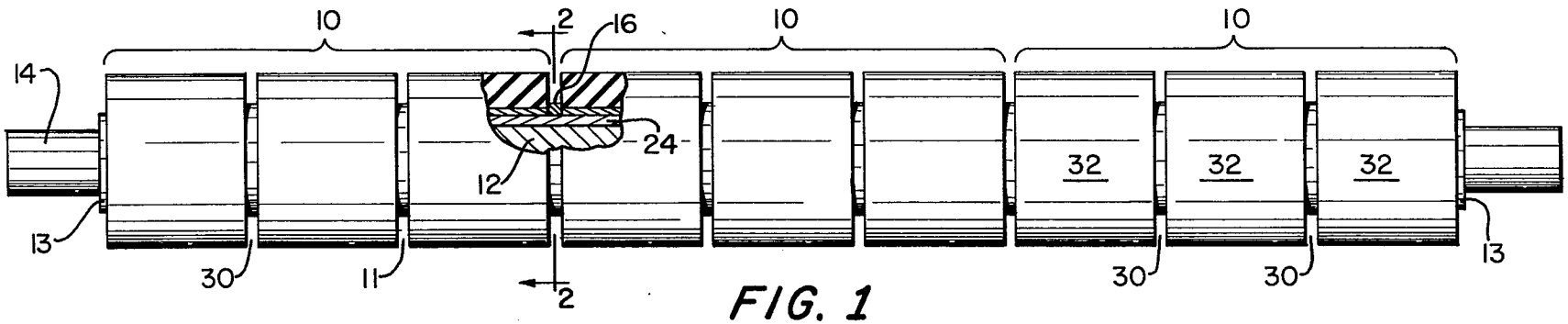
FIG. 1 is a plan view of a guide roller assembly in accordance with a preferred embodiment of the invention, including partially sectioned portions.

Referring now to FIG. 1, three of flexible surfaced roll segments 10 are mounted on a shaft 12 having stub ends 14. The roll segments are held in place by spring clamps 13 and are separated from each other along the length of the shaft by washer-form ring spacers 16.

Figure 2:
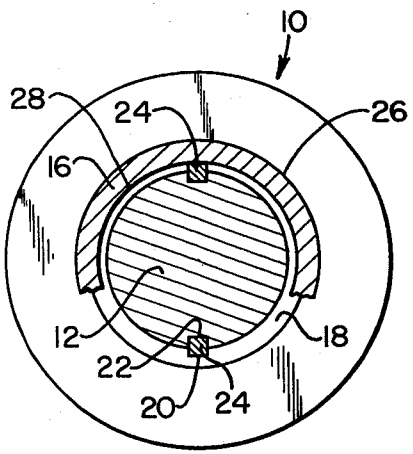
FIG. 2 is a sectional view of the FIG. 1 apparatus along section 2—2 in FIG. 1.

Referring now to FIG. 2, each roll segment comprises an annular stiffening core 18, preferably made of metal, extending flush with the ends of such segment. Opposing keyways 20 and 22 are contained in the cores 18 and shaft 12, respectively. Keyways stabling insert bars 24 are insertable through the opposing keyways 20 and 22 to lock shaft 12 and cores 18 against relative rotation.

In order to assemble the apparatus of this embodiment, segments 10 and spacers 16 alternately slide over shaft 12. The outer surface 26 of each spacer 16 is of lesser diameter than the outer diameters of segments 10. The inner surface 28 of each spacer 16 clears keyway stabling insert bars 24. Each segment 10 comprises two notches 30 therein (FIG. 1) defining three islands 32.

As an alternative to the ambodiment shown in FIGS. 1 and 2, each roll segment may be narrower and form a respective island 32 with a spacer ring 16 between each consecutive pair of roll segments to provide a roller assembly with more roll segments of the same dimensions and general web handling characteristics as the roller assembly shown in the embodiment of FIGS. 1 and 2 while facilitating still less costly replacements.

The flexible surfaced segments comprise such materials as polyurethane or rubber or other elastomeric materials or the like, any of which may be assembled over the stiffening cores 18. The segments have sufficient frictional grip on the core to avoid relative rotation between the segments and the core.

In either of the above described embodiments and in other embodiments within the scope of the invention, the separating rings 16 are of sufficient internal diameter that they slide easily over the keys 24 projecting from keyway 22 of the shaft between segments 10.

It is evident that those skilled in the art may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Web drawing roller assembly for drawing plastic film comprising, means defining an elongated central shaft support for carrying roll segments, means defining a plurality of flexible surfaced roll segments arranged in longitudinal array along nearly the entire length of the shaft for bearing against a plastic film web to be guided with a gap between each pair of adjacent segments that is less than the actual length of each segment, means for detachably securing each of said roll segments to said central shaft whereby any of said roll segments may be replaced when worn, each roll segment including means defining a central stiffening core of annular form fitting over said shaft support, said means for detachably securing comprising means for keying together the central stiffening cores and said shaft support to prevent relative rotation therebetween while allowing longitudinal sliding therebetween for assembly and disassembly of the roll segments with the shaft, and means for separating axially adjacent roll segments to establish the gaps between each pair of adjacent segments, each of said roll segments comprising multiple flexible surfaced portions separated by notched depressions in the segment.

2. Web drawing roller assembly in accordance with claim 1 wherein said keying means comprise opposed keyways on said shaft and segment cores and means defining at least one key bar of greater length than the individual segments which is insertable through said opposed keyways to lock the shaft and segment cores against relative rotation.

3. Web drawing roller assembly in accordance with claim 1 wherein at least three of said roll segments are provided in longitudinal array along the length of the shaft.

4. Web drawing roller assembly in accordance with claim 1 wherein the central stiffening cores and surrounding flexible surfaced material of each segment have axially flush ends.

5. Web drawing roller assembly in accordance with claim 1 wherein said separating means comprise means defining separating rings of lesser outer diameter than the outer diameter of the flexible surfaced segments for separating adjacent ones of said segments.

6. Web drawing roller assembly in accordance with claim 5 wherein said keying means comprise opposed keyways on said shaft and segment cores and means defining at least one key bar of greater length than the individual segments which is insertable through said opposed keyways to lock the shaft and segment cores against relative rotation, and wherein said separating rings have sufficiently large internal area to clear said key bar.

* * * * *